US006554397B1

(12) United States Patent
Williams

(10) Patent No.: US 6,554,397 B1
(45) Date of Patent: Apr. 29, 2003

(54) PEN POSITIONING IN PAGE WIDE ARRAY PRINTERS

(75) Inventor: Kenneth R. Williams, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/969,746

(22) Filed: Oct. 2, 2001

(51) Int. Cl.[7] ..... B41J 2/155
(52) U.S. Cl. ..... 347/42
(58) Field of Search ..... 347/40, 13, 42, 347/20, 86, 85

(56) References Cited

U.S. PATENT DOCUMENTS 5,469,199 A 11/1995 Allen et al.
6,322,204 B1 * 11/2001 Blum et al. ..... 347/74

OTHER PUBLICATIONS

Ross R. Allen, "Ink Jet Printing with Large Pagewide Arrays: Issues and Challenges", pp. 114–120.

* cited by examiner

*Primary Examiner*—Thinh Nguyen
(74) *Attorney, Agent, or Firm*—Roth & Goldman

(57) ABSTRACT

A method and apparatus for positioning a fluid ejection device such as an inkjet pen, or a plurality of aligned fluid ejection devices, on a supporting frame known as a printbar for page wide array printing involves provision of datum surfaces on each ejection device in two orthogonally related planes. First datum surfaces on the bottom of the devices support the device in a Z direction and second datum surfaces on opposite generally vertically extending sides of the fluid ejection devices are provided near the remote ends of the devices outwardly of electrical interconnects on each side of the devices. The device interconnects resiliently electrical interconnects mounted on the frame causing rotation of the devices to position the second datum surfaces on the device against positioning surfaces of the printbar to hold each fluid ejection device in correct position.

18 Claims, 7 Drawing Sheets

PEN POSITIONING IN PAGE WIDE ARRAY PRINTERS

BACKGROUND OF THE INVENTION

The present invention relates to the art of fluid ejection devices and, more particularly, to inkjet printers which use a plurality of pens supported in a page wide array in a frame referred to herein as a printbar which extends across a path of movement of media on which printing is to take place. The individual pens used in this field usually comprise generally rectangular configured fluid containing housings of molded plastic or other suitable material so that a number of pens can be aligned end-to-end in the printbar. Maximization of the size of the pens for ease of manufacture and close positioning of the pens in the printbar without pen-to-pen contact is important for accurate ink drop placement and in keeping size of the printer footprint to a minimum. For these reasons it is considered particularly advantageous to utilize pens which have protruding fore and aft lower orifice array portions on opposite sides of the lower portion of the pen so that the pens can be aligned with the fore and aft portions of adjacent pens in a side-to-side or nested relationship. These pens are rotationally symmetrical about a vertical axis. Electrical interconnects comprising conductive contacts arranged in a pattern are provided on opposite sides of the pen and mating electrical contacts are mounted on the frame for engagement with the interconnects on the pens for transmitting power to control the ejection of fluid from the pens. The pens must be closely and accurately positioned without contacting each other and they must each be stabilized against linear and rotational movement in the spaces on the printbar in which they are mounted.

Microscopic fluid droplets are ejected usually downwardly from thermal or piezoelectric printheads onto media on which a print pattern is to be produced from orifice plates mounted on the lower surfaces of the pens. The need for precise alignment of the pens relative to the frame or printbar on which they are supported is apparent to those skilled in the art.

SUMMARY OF THE INVENTION

The present invention therefore provides a method of positioning one or more fluid ejection devices such as an inkjet pen which ejects fluid in a first (Z) direction in a support, said device having electrical interconnects on opposite sides of said device which resiliently engage spaced electrical interconnects on said support which are spaced in a second (X) direction substantially orthogonal to said first direction, comprising inserting said device in said first direction into a mounting location in said support until said device engages said support and engaging datum surfaces on said opposite sides of said device located proximate opposite ends of said device with datum surfaces on said support during insertion of said device to resist rotation of said device about an axis parallel to said first direction.

The present invention further provides a fluid ejection assembly comprising a frame and one or more fluid ejection devices positioned in aligned mounting locations on said frame, the or each device comprising a housing for containing fluid, electrical interconnects on opposite sides of said housing and first datum surfaces on said opposite sides of said housing located between an interconnect and one of spaced ends of said housing, said frame including supports engageable with said device to position said device in a first (Z) direction in said mounting location and positioning surfaces on said frame engageable with said first datum surfaces on said opposite sides of said housing.

DETAILED DESCRIPTION OF THE PREFERRED EMBODIMENTS

Figure 1:
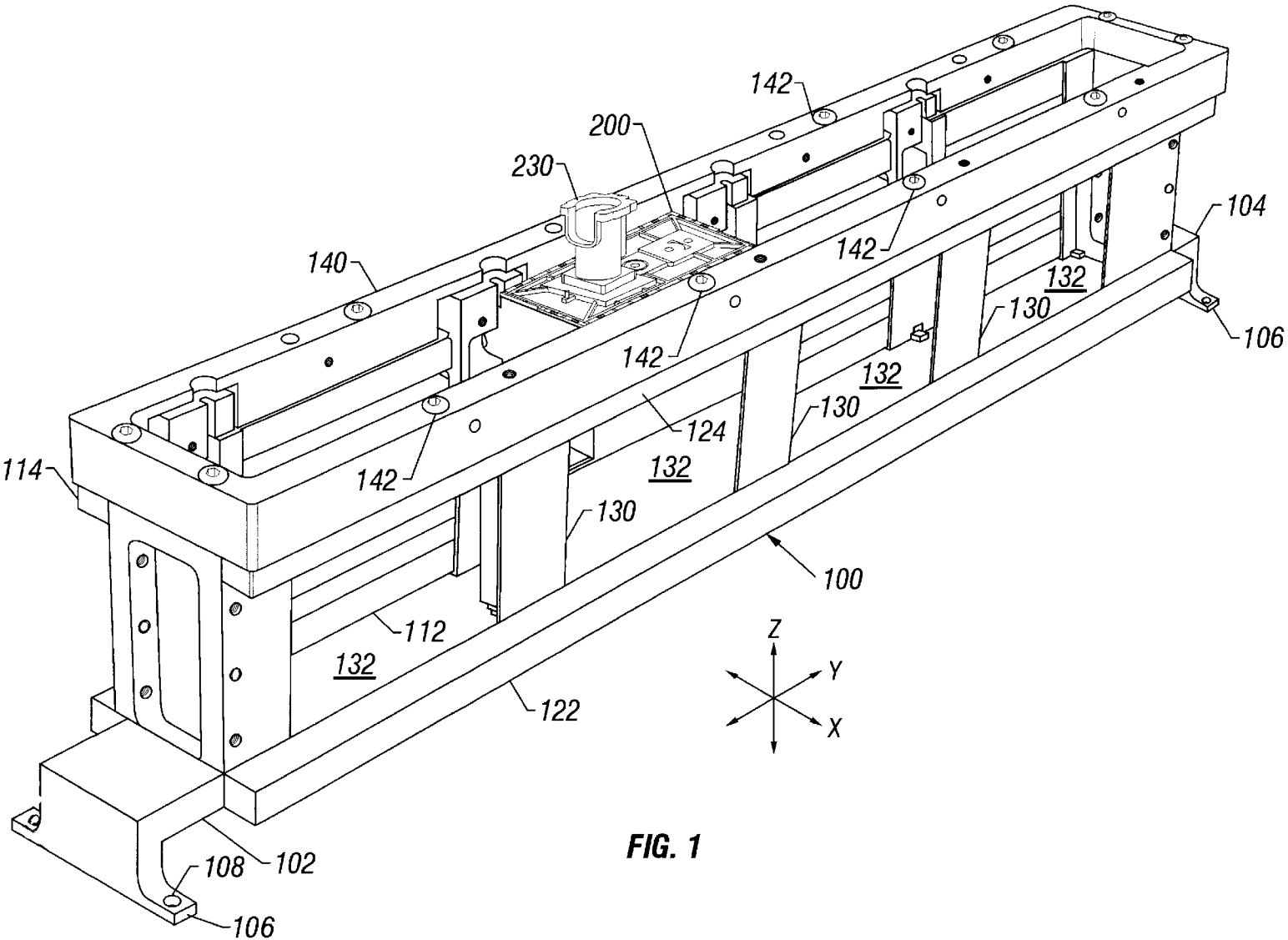
FIG. 1 is a perspective view of a printbar which holds a plurality of inkjet pens for a page wide array printer.
Figure 6:
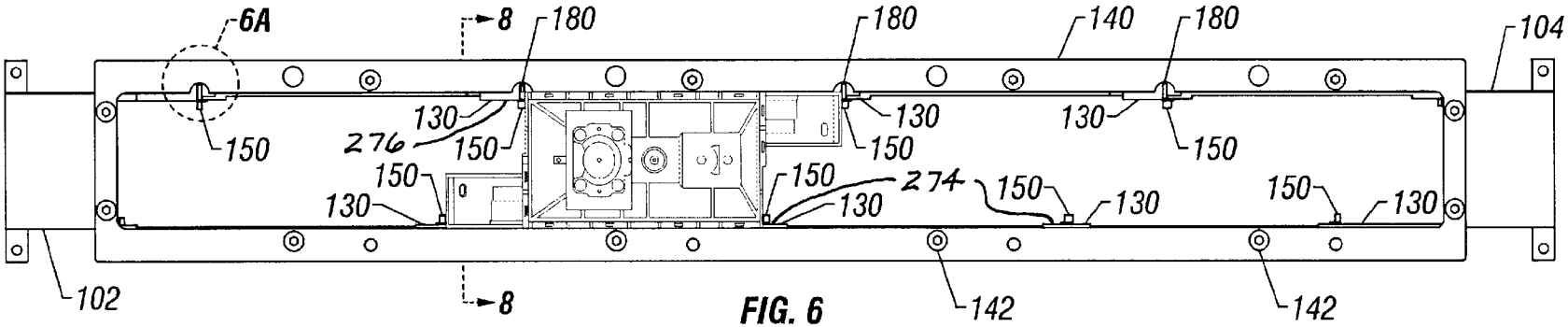
FIG. 6 is a top plan view of the printbar of FIG. 1 with one pen installed in a pen pocket therein.
Figure 6A:
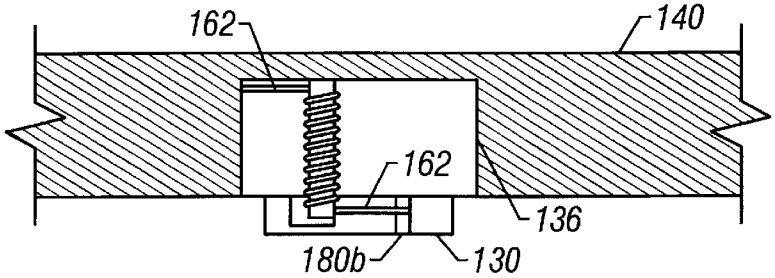
Figure 7:
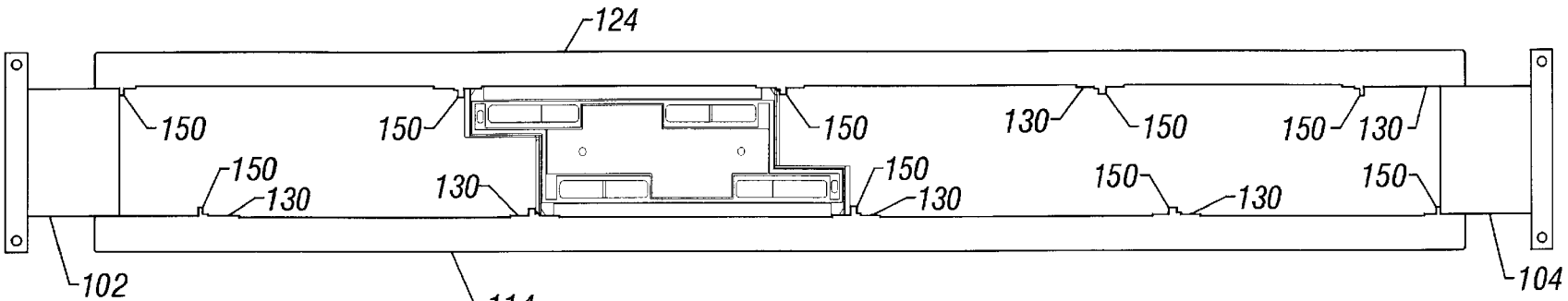
FIG. 7 is a bottom plan view of the printbar and pen seen in FIG. 6, FIG. 6A showing a portion thereof to an enlarged scale.

The invention will be described with reference to a rectangular coordinate system in which the X, Y and Z directions extend as seen in FIG. 1. A frame or printbar 100, elongated in the Y direction, is shown for supporting an aligned plurality of fluid ejection devices such as inkjet pens includes spaced end pieces 102, 104 each having supporting feet 106 with apertures 108 for attaching of the printbar 100 to printer chassis structure. The exemplary printbar shown in the drawings includes a pair of spaced side frames 110, 120 each having elongated lower beams 112, 122 and upper beams 114, 124 connected by spaced columns 130 which extend in the Z direction which is generally vertical as shown. The spaced columns 130 define windows 132 therebetween for reception of electrical interconnects (not shown) assembled onto the printbar which mate with electrical interconnects on the inkjet pens when installed in the respective pen locations in the printbar 100. As seen when comparing thee top plan view of FIG. 6 with the bottom plan view of FIG. 7, the columns 130 and windows 132 are not directly aligned with each other on opposite sides of the printbar. A rectangular cover 140 may be provided and affixed to the upper beams 114, 124 and to the end pieces 102, 104 by a plurality of fasteners 142 or any other suitable means.

Spaced generally horizontally extending Z-datum supports 150 protrude inwardly of the frame in the X direction from the lower ends of the columns 130 for supporting the fluid ejection devices.

Figure 2:
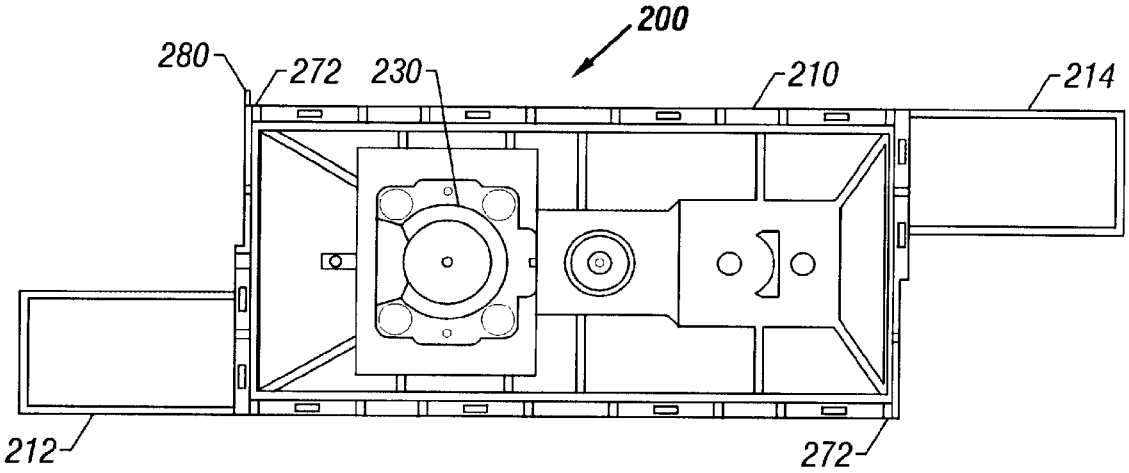
FIG. 2 is a top plan view of an inkjet pen.
Figure 4:
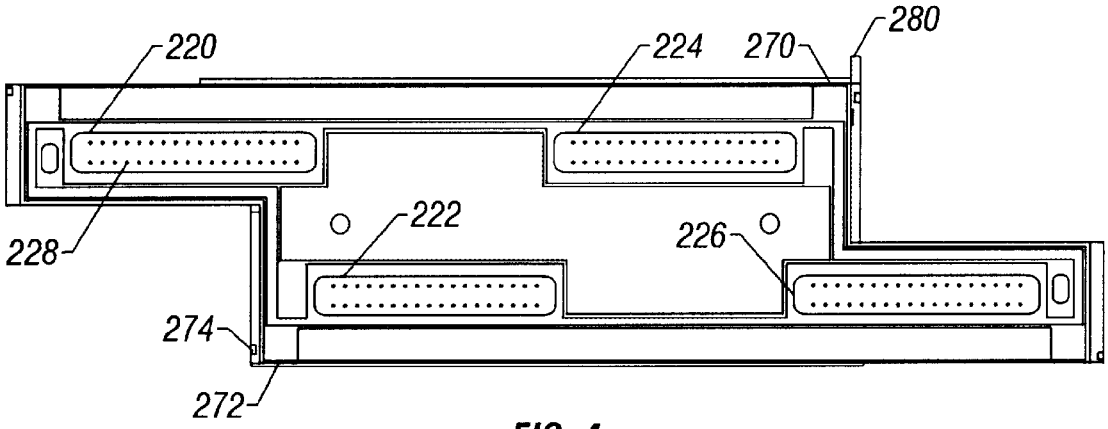
FIG. 4 is a bottom plan view of the pen of FIG. 2.

One or more fluid ejection devices such as inkjet pens 200 are received in individual mounting locations or pockets (four are shown in the illustrated example) in the printbar 100. Each pen 200 is comprised of a generally rectangular plastic housing 210 having protruding fore and aft portions 212, 214 at the lower portion of each pen so that the lower portion of each pen can be said to define a generally offset or S configuration as best seen in FIGS. 2 and 4. The bottom plan view of the pen seen in FIG. 4 shows four elongated overlapping (in the Y direction) nozzle arrays 220, 222, 224, 226 which each contain inkjet orifices 228 through which ink may be fired by electrical activation of fluid vaporizing resistors or by piezoelectric firing as is conventional. Each pen housing 210 may contain a supply of ink and may also be provided with a fill port 230 for replenishment of ink in the housing from remote sources of ink, not shown.

Generally rectangular recesses 240, 250 are formed in the offset lower portions 212, 214 of the housing for reception of electrical interconnects 242, 252 which may be resilient and engageable with similarly configured resilient electrical interconnects (not shown) which are positioned in the windows 132 of the printbar 100 during assembly of the printer so that fluid droplet firing energy can be supplied to each pen 200. The electrical interconnects 242, 252 are not directly aligned in the X direction since they are on the oppositely facing sides of the fore and aft lower portions 212, 214 of the housing 210.

Figure 3A:
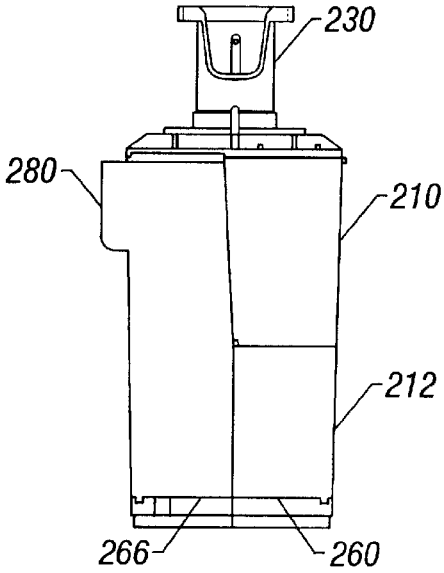
FIGS. 3A and 3B respectively comprise left and right side elevation views of the pen of FIG. 2.
Figure 3B:
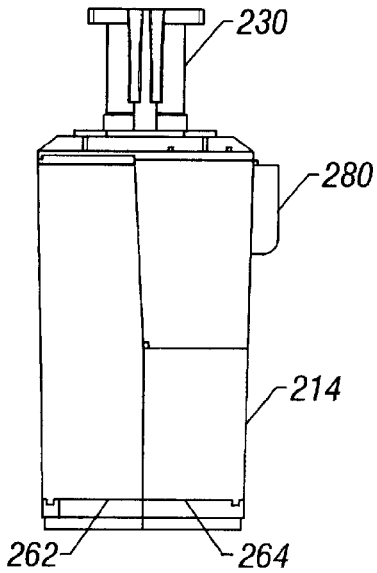
Figure 5A:
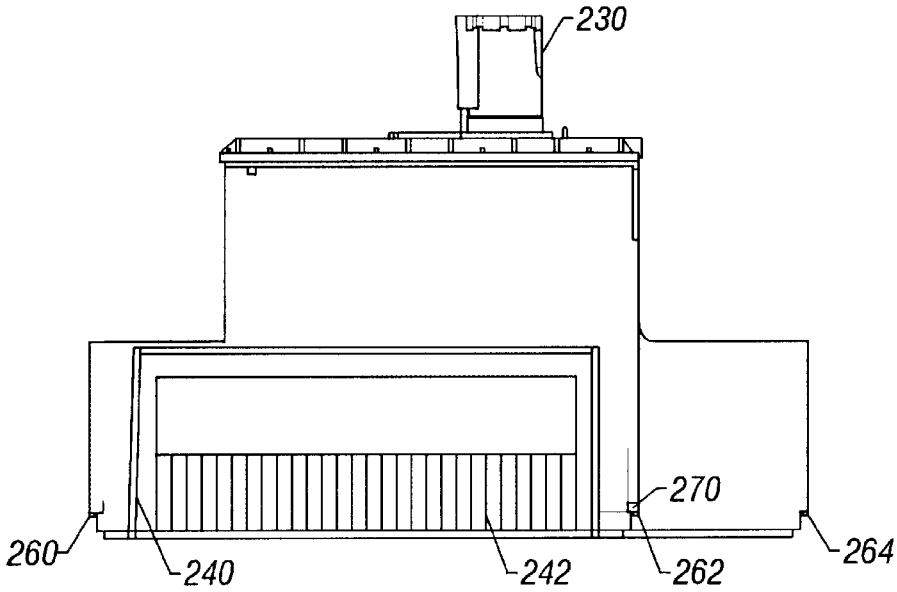
FIGS. 5A and 5 B respectively comprise front and rear elevation views of the pen of FIG. 2.
Figure 5B:
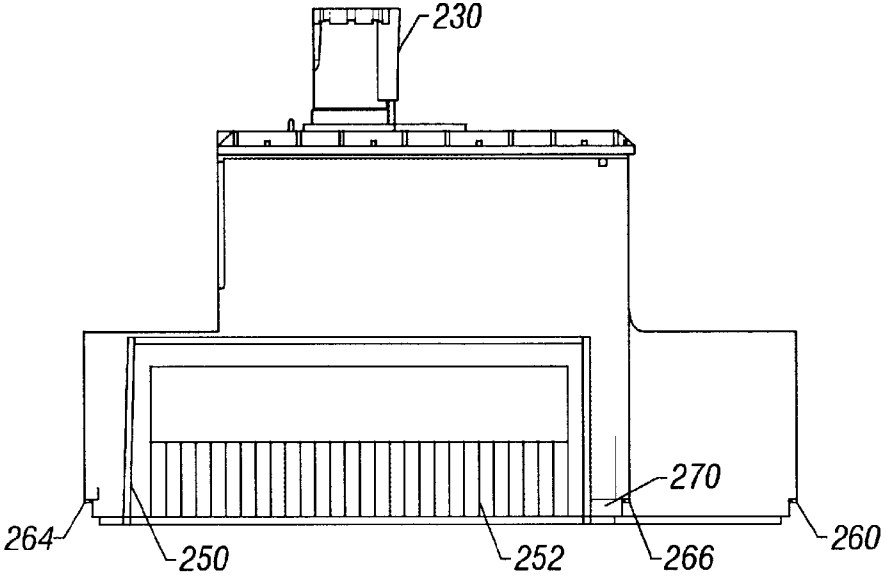

As seen in FIGS. 3 and 5, the pen housing 210 is configured with shoulders which define horizontally extending Z datum surfaces 260, 262, 264 in the locations shown on the housing which engage the spaced Z datum supports 150 on the printbar 100 to provide accurate Z direction positioning and support for the pens 200 when properly positioned in the printbar 100. Three of the Z datum surfaces are operational and one is redundant and rotationally position teach pen about the X and Y axes when the pen is held in place by a latch (not shown) which urges the pen in the Z direction to engage the Z datum surfaces with the supports 150.

Figure 8:
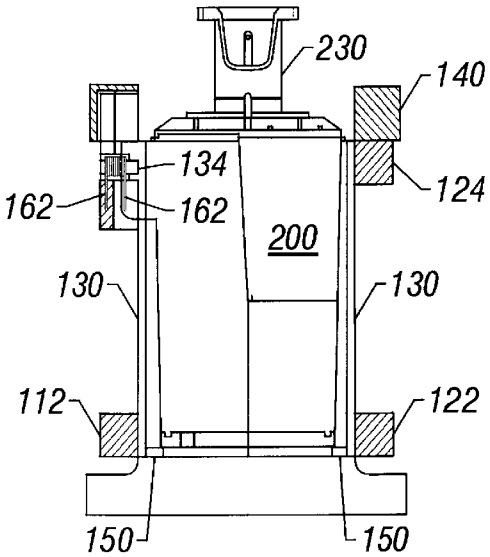
FIG. 8 is a vertical cross-section view taken at lines 8—8 on FIG. 6.
Figure 9:
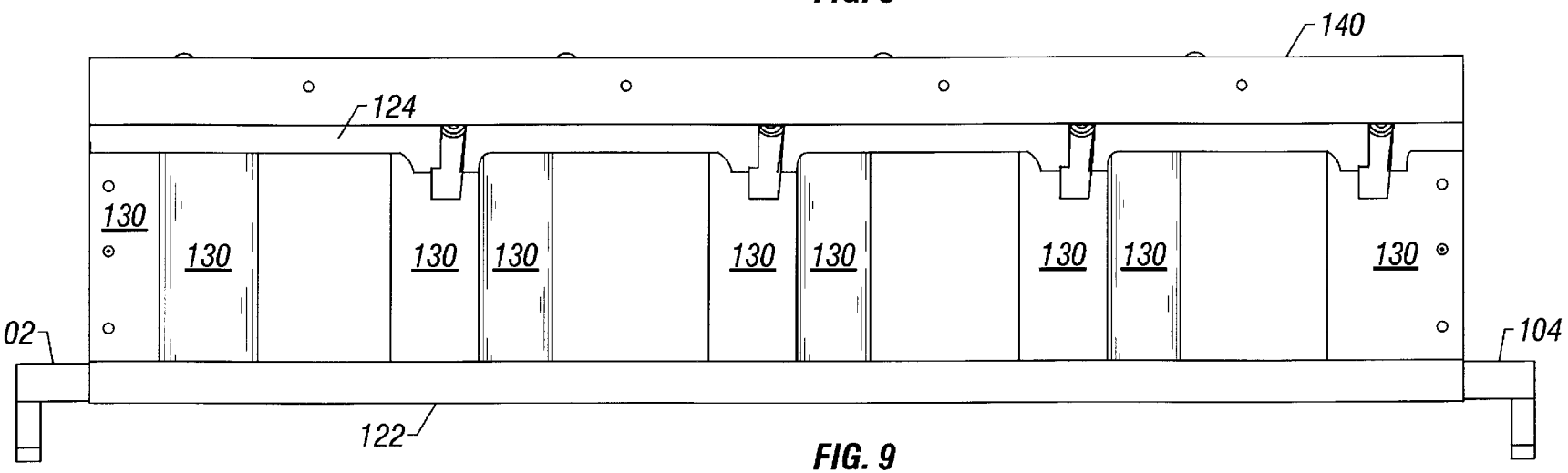
FIGS. 9, 9A is a side plan view as seen on FIG. 6, FIG. 6A.
Figure 9A:
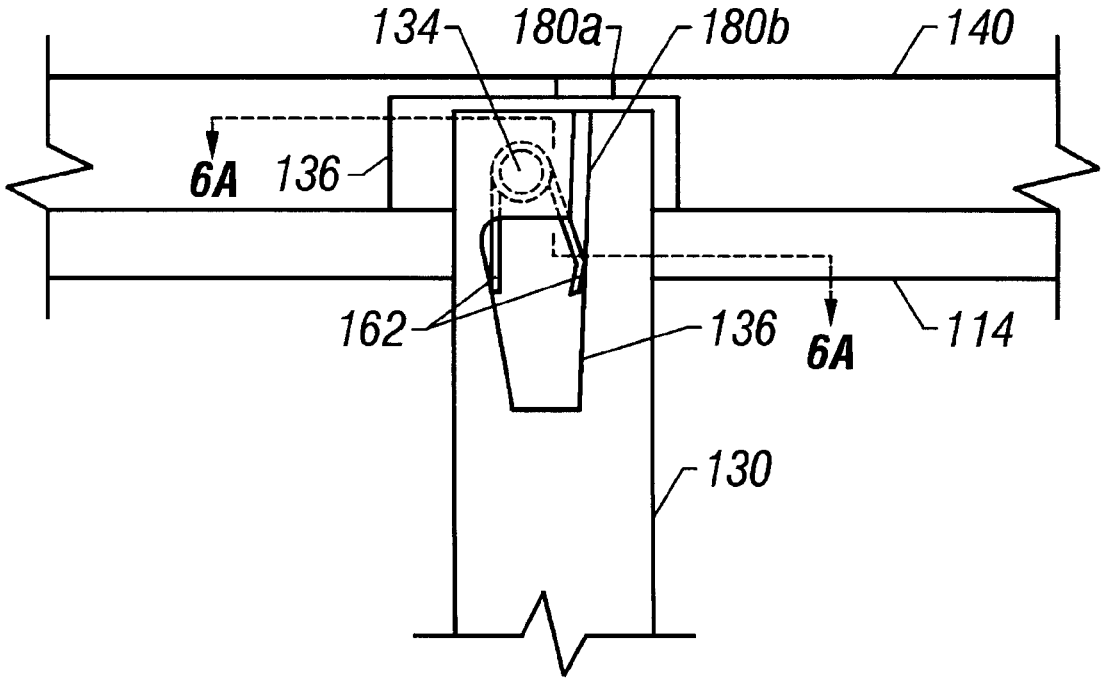

Accurate positioning of the pens 200 in the X direction is provided by two vertically extending datum surfaces 270, 272 in the locations shown on the diagonally opposite lower corners of the main housing portion 210. These X datum surfaces 270, 272 engage X datum surfaces 274, 276 which slightly protrude inwardly from the inner faces of the columns 130 near the supports 150. The pens are held in the correct position by engagement of the X datum surfaces on the pen with the X datum surfaces on the columns due to the bias provided by the contact of the resilient electrical interconnects 242, 252 on the pens with mating resilient electrical interconnects which have been installed in the windows of the printbar. This engagement of the pen X datum surfaces 270, 272 with the column X datum surfaces 274, 276 provides both accurate linear positioning of each pen in the X direction and prevents rotation of the pens 200 around a line parallel to the Z axis (which as shown is generally vertical) which ordinarily would occur due to pen biasing when the electrical interconnects 242, 252 on the pens resiliently engage the electrical interconnects on the printbar 100 during installation of a pen into its mounting location. FIG. 8 shows one pen having its X datum surface 272 properly positioned in contact with an X datum surface 276 on the inside of the column 130 seen to the left of the pen.

The electrical interconnects 242, 252 are provided on both sides of the S-shaped pens 200 because there is not enough room on one side surface for all of the electrical connections which need to be made. It is desirable that the interconnects on the opposite sides of the pen be identical but, as previously mentioned, due to the S configuration of the lower portion of the pen, the interconnects are not aligned with each other in the X direction. Accordingly, the contact forces generated by deflection of resilient electrical interconnects during installation of the pens 200 in the printbar 100 tends to twist the pens around axes extending in the Z direction. The X datum surfaces 270, 272 are positioned to engage like X direction datum surfaces 274, 276 on the columns 130 and thus resist the twisting moment without the necessity for special bias springs as is typical in the prior art. Accordingly, the cost of providing reliable biasing springs to oppose X direction pen motion and the increased pen-to-pen spacing required thereby is avoided leading to closer pen spacing and reduced costs.

Persons skilled in the art will also appreciate that various additional modifications can be made in the preferred embodiments shown and described above and that the scope of protection is limited only by the wording of the claims which follow. Parenthetical directional references in the claims are provided for convenience and are not intended as limitations on the scope of protection.

What is claimed is:

1. A method of positioning a fluid ejection device which ejects fluid in a first (Z) direction in a support, said device having electrical interconnects on opposite sides of said device which resiliently engage spaced electrical interconnects on said support which are spaced in a second (X) direction substantially orthogonal to said first direction, comprising inserting said device in said first direction into a mounting location in said support until said device engages said support and engaging datum surfaces on said opposite sides of said device located proximate opposite ends of said device with datum surfaces on said support during insertion of said device to resist rotation of said device about an axis parallel to said first direction.

2. The method of claim 1, including positioning multiple one of said devices in endwise alignment in a third (Y) direction on said support, said third direction being substantially orthogonal to said first and second directions, and engaging said datum surfaces on said opposite sides of said devices with additional ones of said datum surfaces on said support.

3. A method of positioning multiple fluid ejection devices mounted in a support, said devices having electrical interconnects on opposite sides of each said device which resiliently engage spaced electrical interconnects on said support, comprising inserting said devices in a first (Z) direction into a mounting location in said support until said devices engage said support while engaging datum surfaces on said opposite sides of said devices located proximate opposite ends of each said device with datum surface on said support during insertion of said devices to resist rotation of said devices about axes parallel to said first direction.

4. The method of claim 3, further comprising ejecting fluid from said devices in said direction, said electrical interconnects on said support being spaced in a second direction (X) substantially orthogonal to said first direction.

5. The method of claim 4, comprising aligning multiple ones of said devices end-to-end in said support in a third (Y) direction substantially orthogonal to said first and second directions.

6. A fluid ejection assembly comprising a frame and at least one fluid ejection device positioned in a mounting location on said frame, said device comprising a housing for containing fluid, electrical interconnects on opposite sides of said housing and first datum surfaces on said opposite sides of said housing located between an interconnect and one of spaced ends of said housing, said frame including supports engageable with said device to position said device in a first (Z) direction in said mounting location and positioning surfaces on said frame engageable with said first datum surfaces on said opposite sides of said housing.

7. The assembly of claim 6, wherein said housing includes second datum surfaces for engaging said frame supports.

8. The assembly of claim 7, wherein said fluid ejection device includes orifices for directing fluid from said device in said first (Z) direction.

9. The assembly of claim 8, wherein said fluid ejection device has fore and aft portions which extend in a second (Y) direction substantially orthogonal to said first (Z) direction, said orifices being in said fore and aft portions.

10. The assembly of claim 9, wherein said fore and aft portions are offset from each other in a third (X) direction substantially orthogonal to said first and second directions, said interconnects being mounted on said fore and aft portions.

11. The assembly of claim 10, wherein said frame includes a plurality of mounting locations aligned in said second direction and a plurality of said devices mounted in said locations, said frame having positioning surfaces for engagement with each of said datum surfaces.

12. A fluid ejection assembly comprising a frame and at least one fluid ejection device positioned in a mounting location on said frame, said device comprising a housing for containing fluid and orifices for ejecting fluid from said housing in a first (Z) direction, electrical interconnects on opposite sides of said housing and first datum surfaces on said opposite sides of said housing located between an interconnect and one of spaced ends of said housing, said frame including supports engageable with said device to position said device in said first (Z) direction in said mounting location and positioning surfaces on said frame engageable with said first datum surfaces on said opposite sides of said housing.

13. A fluid ejection assembly comprising a frame and at least one fluid ejection device positioned in a mounting location on said frame, said device comprising a housing for containing fluid, fore and aft portions of said housing having orifices therein for ejecting fluid from said housing in a first (Z) direction, electrical interconnects on opposite sides of said housing on said fore and aft portions spaced in a second (X) direction orthogonal to said first direction, and first datum surfaces on said opposite sides of said housing located between an interconnect and one of ends of said fore and aft portions spaced in a third (Y) direction orthogonal to said first and second directions, said frame including supports engageable with said device to position said device in said first (Z) direction in said mounting location and positioning surfaces on said frame engageable with said first datum surfaces on said opposite sides of said housing.

14. The assembly of claim 13, wherein said fore and aft portions are offset from each other in said third direction.

15. An inkjet printer which includes a frame and at least one inkjet pen positioned in a mounting location on said frame, said pen comprising a housing for containing fluid, electrical interconnects on opposite sides of said housing and first datum surfaces on said opposite sides of said housing located between an interconnect and one of spaced ends of said housing, said frame including supports engageable with said pen to position said pen in a first (Z) direction in said mounting location and positioning surfaces on said frame engageable with said first datum surfaces on said opposite sides of said housing.

16. The printer of claim 15, wherein said frame includes a plurality of aligned mounting locations and a plurality of said pens mounted in said locations, said frame having surfaces for engagement with each of said datum surfaces.

17. The printer of claim 16, wherein said housing has fore and aft portions on opposite sides of said housing, said interconnects being mounted on said fore and aft portions.

18. An inkjet printer comprising a frame and at a plurality of one fluid ejection device positioned in aligned mounting locations on said frame, said devices each comprising a housing for containing fluid, said housing having fore and aft portions with orifices therein for ejecting fluid from said housing in a first (Z) direction, electrical interconnects on opposite sides of said housing on said fore and aft portions spaced in a second (X) direction orthogonal to said first direction, and first datum surfaces on said opposite sides of said housing located between an interconnect and one of ends of said fore and aft portions spaced in a third (Y) direction substantially orthogonal to said first and second directions in which said devices are aligned, said frame including supports engageable with said devices to position said devices in said first (Z) direction in said mounting locations and positioning surfaces on said frame engageable with said first datum surfaces on said opposite sides of said housings.

* * * * *